US006086650A

United States Patent [19]

Carpenter

[11] Patent Number: 6,086,650

[45] Date of Patent: Jul. 11, 2000

[54] CEMENTED CARBIDE FOR OIL AND GAS APPLICATIONS

[75] Inventor: Michael John Carpenter, Nuneaton, United Kingdom

[73] Assignee: Sandvik Aktiebolag, Sandviken, Sweden

[21] Appl. No.: 09/340,724

[22] Filed: Jun. 29, 1999

[51] Int. Cl.[7] ..... C22C 29/08

[52] U.S. Cl. ..... 75/240; 75/242

[58] Field of Search ..... 75/240, 242

[56] References Cited

U.S. PATENT DOCUMENTS

| | | | |
|---|---|---|---|
| 3,746,519 | 7/1973 | Hara et al. . | |
| 3,993,446 | 11/1976 | Okawa . | |
| 4,466,829 | 8/1984 | Nishigaki et al. . | |
| 4,497,660 | 2/1985 | Lindholm | 75/240 |
| 5,902,942 | 5/1999 | Maderud et al. . | |

FOREIGN PATENT DOCUMENTS

| | | |
|---|---|---|
| WO 80/02569 | 11/1980 | WIPO . |
| WO 92/13112 | 8/1992 | WIPO . |

OTHER PUBLICATIONS

Swedish Search Report for Swedish Application No. 9802324–5.

*Primary Examiner*—Ngoclan Mai

*Attorney, Agent, or Firm*—Burns, Doane, Swecker & Mathis, L.L.P.

[57] ABSTRACT

The present invention relates to a cemented carbide with excellent properties for oil and gas applications including resistance to the combined erosion and corrosion synergistic effects at temperatures between −50 and 300° C., preferably 0–100° C. The cemented carbide contains, in wt %, 2.5–4.5 (Co+Ni) with a weight ratio Co/Ni of about 3, 0.25–0.6 Cr and 0.1 Mo wherein essentially all of the WC grains have a size <1 μm and wherein the total carbon content is in the interval of 6.13–(0.061±0.008)×binder phase (Co+Ni) content (wt-%).

5 Claims, No Drawings

CEMENTED CARBIDE FOR OIL AND GAS APPLICATIONS

FIELD OF THE INVENTION

The present invention relates to a cemented carbide grade with special properties for oil and gas applications. Moreover the invention refers to a corrosion and erosion resistant grade for choke valves to control the flow of multimedia fluid (e.g., gas, liquid and sand particles).

BACKGROUND OF THE INVENTION

Cemented carbide for applications such as seal rings, bearings, bushings, hot rolls, etc., should have a certain degree of corrosion resistance. A corrosion resistant cemented carbide generally has a binder phase consisting of Co, Ni, Cr and Mo where the Cr and/or Mo act as corrosion inhibiting additions. An example of such a cemented carbide with a medium WC grain size is disclosed in EP 28 620. EP 568 584 discloses the use of a corrosion resistant cemented carbide with submicron WC grain size with excellent properties particularly for tools used in the wood industry.

A critical component of subsea oil/gas production systems is the choke trim components, the primary function of which is to control the pressure and flow of well products. Under severe conditions of multi flow media, these components may suffer from extreme mass loss by exposure to solid particle erosion, acidic corrosion erosion-corrosion synergy and cavitation mechanisms even when fitted with cemented carbide trims.

The opportunity to maintain or replace such equipment in the field especially in offshore deep water sites is limited by weather conditions. It is therefore essential that reliable and predictable products form part of the subsea system.

The composition of the cemented carbide grades presently used for withstanding conditions of service in this type of environment generally consist of tungsten carbide (WC) as the hard component and cobalt (Co) or nickel (Ni) as the binder material to cement together the WC crystals.

To meet the demands of hardness and toughness, the amount of binder and/or the WC grain size are varied and cobalt is generally accepted as the optimum binder constituent. Where corrosion resistance is the predominant consideration then the binder material is usually of a nickel or a nickel+chromium (Ni+Cr) composition.

Analogous to stainless steels, Cr and Ni alloys have improved passivity by reducing the critical currents involved in corrosion, however (Cr+Ni) are not so resistant to halides (seawater) or inorganic acids. For these conditions the addition of molybdenum gives improved corrosion resistance in addition to improving binder strength of Ni.

Recent experimental work, including field trial evaluation, has proven that under high erosion conditions including a corrosion medium, the mechanism of mass loss is due not only to a combination of each individual corrosive condition, but the combination of corrosive conditions is synergistic.

SUMMARY OF THE INVENTION

The present invention relates to cemented carbides with excellent properties regarding resistance to the synergistic combined erosion and corrosion effects at temperatures between −50 and 300° C., preferably 0–100° C.

According to the principles of the present invention, a cemented carbide for oil and gas applications having resistance to erosion and corrosion at temperatures between −50° and 300° C. comprising: in wt %, 2.5–4.5% (Co+Ni) with a weight ratio Co/Ni of about 3.0, 0.25–0.6% Cr and 0.1% Mo wherein essentially all of the WC grains have a size <1 μm and wherein the total carbon content is in the interval of 6.13–(0.061±0.008)×binder phase (Co+Ni) content (wt. %).

Further according to the present invention, a choke trim component for use in oil/gas production systems is formed, at least in part, by the cemented carbide described above.

DETAILED DESCRIPTION OF PREFERRED EMBODIMENTS

Resistance to particle erosion under corrosive environments has been achieved by using a specifically optimized multi-alloy binder sintered with a submicron grain size WC (i.e. essentially all of the WC grains have a size <1 μm). The cemented carbide according to the invention has a composition including 2.5–4.5 wt. % (Co+Ni) with a weight ratio Co/Ni of about 3, 0.25–0.6 wt. % Cr and about 0.1 wt. % Mo.

In one preferred embodiment the cemented carbide has the composition, in wt. %, 3.3% Co, 1.1% Ni, 0.52% Cr, 0.1% Mo with the balance of WC with an average grain size of 0.8 μm.

In another preferred embodiment the composition, in wt. %, is 1.9% Co, 0.7% Ni, 0.3% Cr, 0.1% Mo with the balance of WC of 0.8 μm grain size.

The carbon content within the sintered cemented carbide must be kept within a narrow band in order to retain a high resistance to corrosion and wear as well as toughness. The total carbon content shall be in the interval of 6.13–(0.061±0.008)×binder phase (Co+Ni) content (wt-%), preferably 6.13–(0.061±0.005).

The hardness of the cemented carbide according to the invention shall be >1875 HV30, preferably >1900 HV30 and the transverse rupture strength (TRS) as determined according to ISO 3327 (type B test pieces) shall be >2100 N/mm$^2$, preferably >2200 N/mm$^2$.

The cemented carbide of this invention can be manufactured by conventional powder metallurgical methods such as milling, pressing, shaping, sintering and hipping.

The cemented carbide according to the invention is particularly applicable for the choke trim components used in oil and gas industry where components are subjected to high pressures of a multi-media fluid where there is a corrosive environment including seawater.

EXAMPLE 1

A cemented carbide according to the invention had the composition, in wt. %, 3.3% Co, 1.1% Ni, 0.6% $Cr_3C_2$, 0.1% Mo with the balance of WC, a hardness of 1900 HV30 and transverse rupture strength (TRS) of 2350 N/mm$^2$ with a mean WC grainsize of 0.6 μm. It was tested against commercially available cemented carbide grades one made from 6% Co and the other from 6% Ni both with the balance of WC (0.8 μm grain size) under the following simulated test conditions:

synthetic seawater sand 18 m/s $CO_2$ 1 Bar temp 54° C.

The following results were obtained.

| Grade | corrosion (material loss in mm/year) | erosion (material loss in mm/year) | synergistic (material loss in mm/year) | total (material loss in mm/year) |
|---|---|---|---|---|
| WC 6% Co | 0.02 | 0.09 | 0.35 | 0.46 |
| WC 6% Ni | 0.015 | 0.265 | 0.17 | 0.45 |
| invention | 0.015 | 0.06 | 0.025 | 0.10 |

EXAMPLE 2

Cemented carbides were made according to the invention with the composition 3.3% Co, 1.1% Ni, 0.6% $Cr_3C_2$, 0.1% Mo with the balance of WC having a grain size on the order of 0.8 $\mu$m. A similar alloy with 1.9% Co, 0.7% Ni, 0.35% $Cr_3C_2$, 0.1% Mo with the balance of WC was also made. These alloys are referred to as grades 1 and 2 of the invention, respectively. These materials had hardness values of 1900HV30 and 1910HV30 and transverse rupture strength (TRS) of 2350 N/mm$^2$ and 2350 N/mm$^2$, respectively, each with a mean WC grainsize of 0.6 $\mu$m. They were tested against commercially available cemented carbide grades under the following simulated test conditions of seawater and sand.

data

Flow rate: 90 m/sec and impingement angles of 30° and 90°. The following results were obtained.

| Grade | erosion (mm$^3$/kg sand) angle of impingement = 30° | erosion (mm$^3$/kg sand) angle of impingement = 90° |
|---|---|---|
| WC 6% Co | 1.6 | 1.4 |
| WC 6% Ni | 2.1 | 1.6 |
| invention 1 | 0.5 | 0.3 |
| invention 2 | 0.25 | 0.15 |

EXAMPLE 3

A cemented carbide according to the invention with the composition 3.3% Co, 1.1% Ni, 0.6% $Cr_3C_2$, 0.1% Mo, with the balance of WC and a hardness of 1900HV30 and transverse rupture strength (TRS) of 2350 N/mm$^2$ with a mean WC grainsize of 0.6 $\mu$m was tested against commercially available cemented carbide grades. Test conditions of air and sand at 200 m/s:

Flow rate: 200 m/s Air.

The following results were obtained.

| Grade | erosion (mm$^3$/kg sand) angle of impingement = 30° | erosion (mm$^3$/kg sand) angle of impingement = 90° |
|---|---|---|
| WC 6% Co | 2.5 | 4.0 |
| WC 6% Ni | 2.6 | 5.6 |
| invention | 0.8 | 1.4 |

The cemented carbide according to the invention shows significant reduction in wear as measured by volume loss.

While the present invention has been described by reference to specific examples, it is to be understood that numerous modifications and variations will be evident to those skilled in the art. The scope of the present invention being limited only by the spirit and scope of the appended claims.

What is claimed is:

1. A cemented carbide for oil and gas applications having resistance to erosion and corrosion at temperatures between −50° and 300° C. comprising:

in wt %, 2.5–4.5% (Co+Ni) with a weight ratio Co/Ni of about 3, 0.25–0.6% Cr and 0.1% Mo wherein essentially all of the WC grains have a size <1 $\mu$m and wherein the total carbon content is in the interval of 6.13–(0.061±0.008)×binder phase (Co+Ni) content (wt-%).

2. The cemented carbide according to claim 1, wherein the composition comprises, in wt. %, 3.3% Co, 1.1% Ni, 0.52% Cr, 0.1% Mo with balance of WC.

3. The cemented carbide according to claim 1 wherein the composition comprises, in wt. %, 1.9% Co, 0.7% Ni, 0.3% Cr, 0.1% Mo with balance of WC.

4. The cemented carbide according to claim 1, having a carbon content in the interval of 6.13–(0.061±0.005)×binder phase (Co+Ni) content (wt-%).

5. A choke trim component for use in oil/gas production systems formed, at least in part, by the cemented carbide of claim 1.

* * * * *